United States Patent [19]

Manger

[11] 3,937,905

[45] Feb. 10, 1976

[54] MOVING VOICE COIL TRANSDUCER HAVING A FLAT DIAPHRAGM OF AN IMPREGNATED KNIT

[76] Inventor: Josef W. Manger, Karlstadter Strasse 5, 8725 Arnstein, Germany

[22] Filed: July 24, 1973

[21] Appl. No.: 382,157

[30] Foreign Application Priority Data

July 25, 1972 Germany ..... 2236374

[52] U.S. Cl. ..... 179/115.5 R; 179/115.5 DV; 179/119 R; 179/120; 179/181 R; 181/161; 181/167

[51] Int. Cl.[2] ..... H04R 7/04; H04R 9/02

[58] Field of Search ..... 179/115 R, 115.5 R, 117, 179/119 R, 138 R, 181 R; 181/157, 161, 162, 167, 169, 173

[56] References Cited

UNITED STATES PATENTS

| | | | |
|---|---|---|---|
| 1,552,311 | 9/1925 | Kellogg | 181/169 |
| 1,827,283 | 10/1931 | De Forest | 179/115.5 R |
| 1,909,275 | 5/1933 | Holland | 179/115.5 VC |
| 2,115,795 | 5/1938 | Warnke | 179/117 |
| 2,216,961 | 10/1940 | Sanial | 179/117 |
| 2,534,157 | 12/1950 | Zuerker | 179/115.5 R |
| 2,537,253 | 1/1951 | Andersen | 179/115.5 R |
| 2,873,813 | 2/1959 | Haerther, Jr. et al. | 179/181 R |
| 3,790,724 | 2/1974 | Schenkel | 179/119 R |

FOREIGN PATENTS OR APPLICATIONS

| | | | |
|---|---|---|---|
| 70,808 | 4/1950 | Denmark | 179/115.5 R |
| 406,749 | 3/1934 | United Kingdom | 179/115.5 R |
| 1,617 | 5/1926 | Australia | 179/115 R |
| 521,988 | 3/1931 | Germany | 179/115 R |

*Primary Examiner*—Kathleen H. Claffy
*Assistant Examiner*—George G. Stellar

[57] ABSTRACT

An electro-acoustic transducer has a diaphragm with a moving coil. The diaphragm consists of a flat textile carrier impregnated with a highly attenuating filling material and is highly elastic in its plane but inelastic in bending.

13 Claims, 7 Drawing Figures

MOVING VOICE COIL TRANSDUCER HAVING A FLAT DIAPHRAGM OF AN IMPREGNATED KNIT

Figure 1:
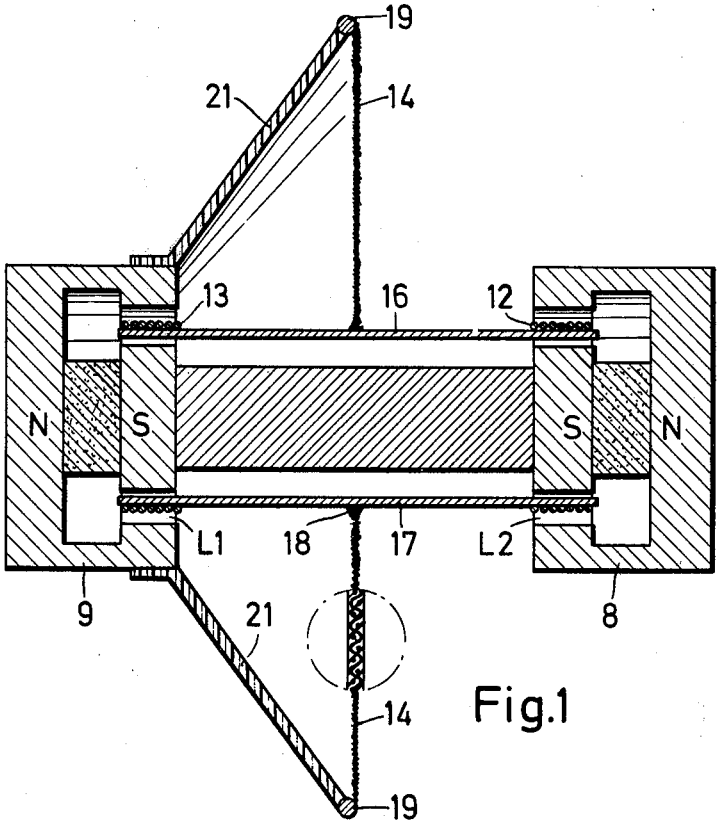

Electro-acoustic transducer systems have been devised for the conversion of applied electrical oscillations into mechanical vibrations which are consequently transformed into acoustic oscillations or into radiated sound waves. The ideal transducer system must, moreover, ensure that the electrical oscillations applied are (within the audio frequency range) converted with such amplitude and phase constants that square-wave oscillations within a range of 100 to 3000 Hz are converted into appropriate sound waves.

As far as practical application is concerned the relevant industry is still a long way off this ideal condition (cf., for example, "Hifi-stereophonie", Zeitschtift fur hochwertige Musikwiedergabe, No. 5/69, Pages 362 to 340). Measurements taken on the most sophisticated of known electro-acoustic transducers have clearly shown not only that all applied electrical oscillations will invariably result in a sound wave train composed of several waves but also that (in dependence on the design and construction of the transducer system) the sound will be reproduced as a distorted sound wave.

The cause for these interferences has been traced to the fact that conventional transducer systems have to be equipped with at least one mechanical energy store. The energy retained in this store during the pulse rise time is, in accordance with the time constant of the store, either instantly or with a delay re-fed to the subsequent cycle. The re-applied energy will thus not only result in distortions but will also extend the radiated wave beyond the limits of the oscillation applied.

The energy is stored in essentially two ways, one of which is the force of inertia and the other by the force of elasticity. An elastic energy store may be represented by the springs required to restore the moving coil to its initial position or by the centering diaphragms used for calotte loudspeakers. This acoustic compliance will, on deflecting the moving coil from its rest position, result in an amplitude-dependent restoring force which reduces the amplitude of the applied oscillations and increases the amplitude on restoring the moving coil. This in turn results in a distortion of the applied oscillations on the one hand and will, on the other hand, cause an overshoot of the moving coil beyond the rest position with the after-oscillations resulting therefrom. The same adverse influence can be attributed to those of the elastic type energy stores especially produced by encapsulated air chambers in small loudspeakers; in fact such elastic stores are occasionally even produced for restoring the moving coils and thus take the place of the restoring springs.

The loudspeaker diaphragm coupled to the moving coil of the electro-acoustic transducer system may be regarded as an energy store based on the force of inertia. Experiments have proved that ideal functioning of the diaphragm can only be warranted if, during deflection of the moving coil, each point of the diaphragm is deflected with exact value. This condition could imaginably be met by a material with as infinite rigidity (modulus of elasticity) which material will be not elastically deformed even at maximum frequencies. Such materials, of a necessarily small mass, are not available. The force of inertia produces natural oscillations inavoidably, therefore, in the known types of diaphragms, at least within the higher frequency ranges.

Attempts have been made to attenuate the natural oscillations of the diaphragm or to exclude their adverse effect on the radiated sound waves. Among other methods attempts have been made to arrive at the essential attenuation by using a woven or bonded fibre fabric as diaphragm material or, alternatively, by impregnating it with a suitable varnish; the diaphragm has also been constructed in a way which assured that at a higher frequency certain sections of the diaphragm, e.g. the marginal sections, take no active part in the radiation of sound waves. Such measures, however, do not result in a remedy of the adverse conditions but rather in an improvement because they are only aimed at a diminishing of the effects of the energy stores and not at an elimination of the stores themselves formed by the diaphragm or the diaphragm construction. Thus, the conventional electro-acoustic transducer systems suitable for all sound frequency ranges comprise a number of transducers each of which has a frequency range of its own (e.g. for treble, middle and bass). Such a construction, therefore, offers the further disadvantage that the rise times of the sound pressure edges in the different transducers do not occur simultaneously but in a sequence. This can be attributed to the fact that LC elements have to be utilised for the determination of the different frequency ranges and also to the use of different masses for the diaphragms.

It has been the purpose and intention of this invention to create the possibility of designing an electro-acoustic transducer which eliminates the said disadvantages and which — in particular — is operated without the said power stores.

According to the present invention there is provided an electro-acoustic transducer system with a diaphragm coupled to a moving coil, the diaphragm consisting of a flat textile carrier element which is impregnated with a highly attenuating filling material and which is made up of a material which is highly elastic in its plane but substantially unelastic in bending.

There is also provided a diaphragm for the electro-acoustic transducer system comprising a substantially flat textile element being impregnated with an intensively attenuating filling material, and having highly flexible properties in its plane but being substantially unelastic in bending. The textile element is preferably composed of a knitted fabric and is preferably fixed with at least one point to a stationary part of the transducer system. Specially suitable for this purpose is a knit or warp knit material which can be extensively stretched in every direction. This textile diaphragm element, may, within the scope of this invention, be treated from both sides with a filling material. This filling material should preferably be applied to a knitted or warp knitted material under a little pre-tension.

There is also provided a method of producing the diaphragm and mounting it in the electro-acoustic system comprising the steps of centering the moving coil within the air gap; placing the textile element on the moving coil ring and on the outer ring, tensioning it radially from several sides preventing thereby creasing, coating it with a diluted filling material within the range of the marginal edges of the outer ring and the moving coil for the purpose of local fixing, and drying it; and then applying the filling material from at least one side to the whole textile element, pre-drying it at a lower temperature and subsequently after-treating it at a raised temperature.

With this invention it is for the first time possible to repudiate the generally accepted opinion that diaphragms must be of a high rigidity if they are, in their entirety i.e. as a rigid body, to follow the reciprocating motions of the moving coil. This principle had been universally applied to all known electro-acoustic transducers or loudspeakers respectively. Measurements and tests, however, have now proved the fallacy of this rule. It must rather be ensured that all moving mass-points are, independently of their amplitude, deflected with the same phase i.e. that the oscillation of the diaphragm is carried out with perfect phase coincidence. It has also proved to be of advantage if the amplitudes are not identical at the different diaphragm points but rather decline in their magnitude from a maximum at the coupling point to a minimum value at the diaphragm edge. Such a phase coincidence and a decline in the amplitude can be ideally realised with the diaphragm of this invention. The most advantageous condition is established if the diaphragm is not only fixed to the moving coil but also to a stationary part of the transducer. This fixing method will warrant that, commencing with the coupling point on the moving coil and progressing towards the fixing point on the stationary part, the oscillation amplitudes gradually decrease and also that a perfect phase coincidence is also maintained within the range of the fixing point. The easily extensible and highly attenuating material used for the diaphragm of this invention will, moreover, ensure that the diaphragm oscillations have no adverse effect on the motion geometry of the moving coil or on the radiated sound waves.

Another decisive advantage offered by the diaphragms of this invention is presented by the fact that they are suitable for wide-band loudspeakers. Measurements taken have shown that these diaphragms follow the oscillations within the bass range practically in their entirety, the amplitudes of these oscillations decreasing, however, as already described, in their magnitude to the outside commencing from the point where they are coupled to the moving coil, whereas a gradually decreasing section of the diaphragm is set in oscillation with increasing frequencies until at maximum frequencies only a minute section (a few millimeters around the coupling point) of the diaphragm is energised. Thus it is ensured that a desirably increasing radiation surface is made automatically available as the frequencies become lower while, on the other hand, the marginal zones being critical for the excitation of natural oscillations are automatically excluded at high frequencies. A special property of the diaphragm of this invention is found in the fact that it may be regarded as an oscillating system comprising a multitude of individual mass-points interconnected by springs; the attenuation effect of the filling material inhibits a high elasticity of these springs which thus are provided with a considerable internal damping. These viscoelastic properties have made it possible, as documented with tests conducted with a torsional pendulum, that the logarithmic damping decrement ascertained for the diaphragm of this invention exceeds those of conventional diaphragms (of bonded fibre fabrics etc.) by four to 15 times.

This invention has, for the first time, created the possibility of designing and constructing a transducer system without making use of a mechanical energy store. This system can be further developed by providing a transducer without the detrimental enclosed air chambers on the input or the output side of the diaphragm, and by replacing the acoustic compliance used for restoring the moving coil with a system of electromagnetic centering (British Pat. No. 1286687, U.S. Pat. No. 3686446). An electro-acoustic transducer system incorporating these features offers ideal properties, because all mechanical energy stores are as small as possible and a deceleration of the masses is not obtained by means of elastic means as in known transducer systems, but by means of frictional resistances. The energy released during the deceleration will, therefore, be dissipated in the form of heat and in consequence can not adversely influence the subsequent cycles of oscillation.

Figure 2:
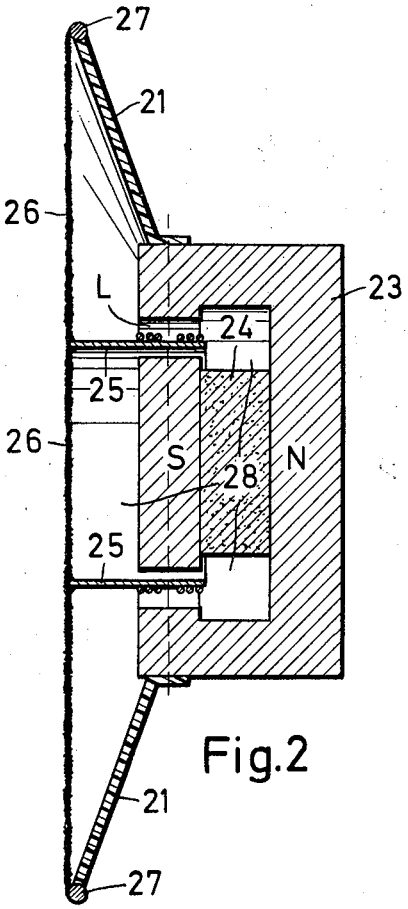
Figure 2A:
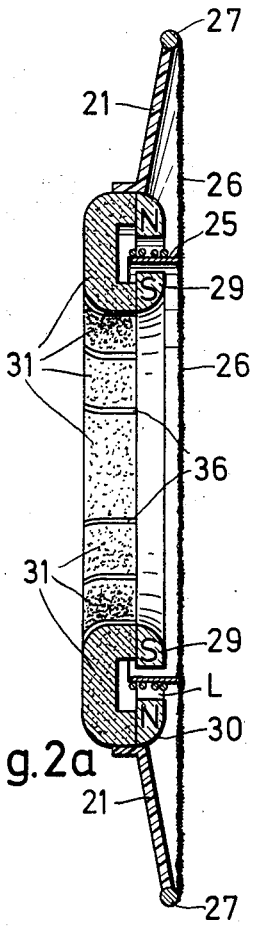
Figure 3:
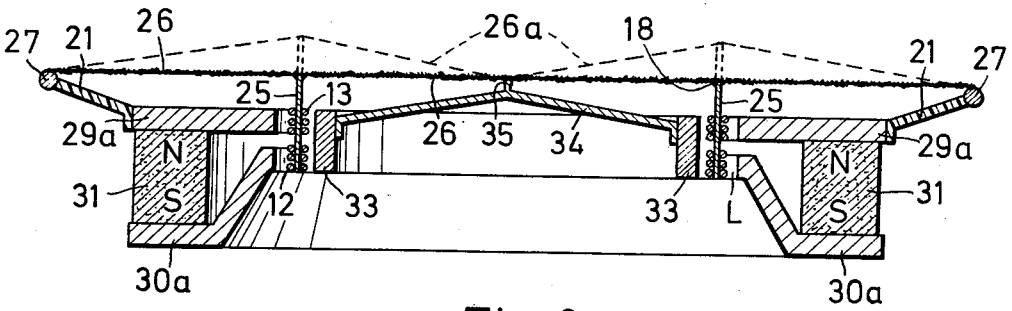
Figure 4:
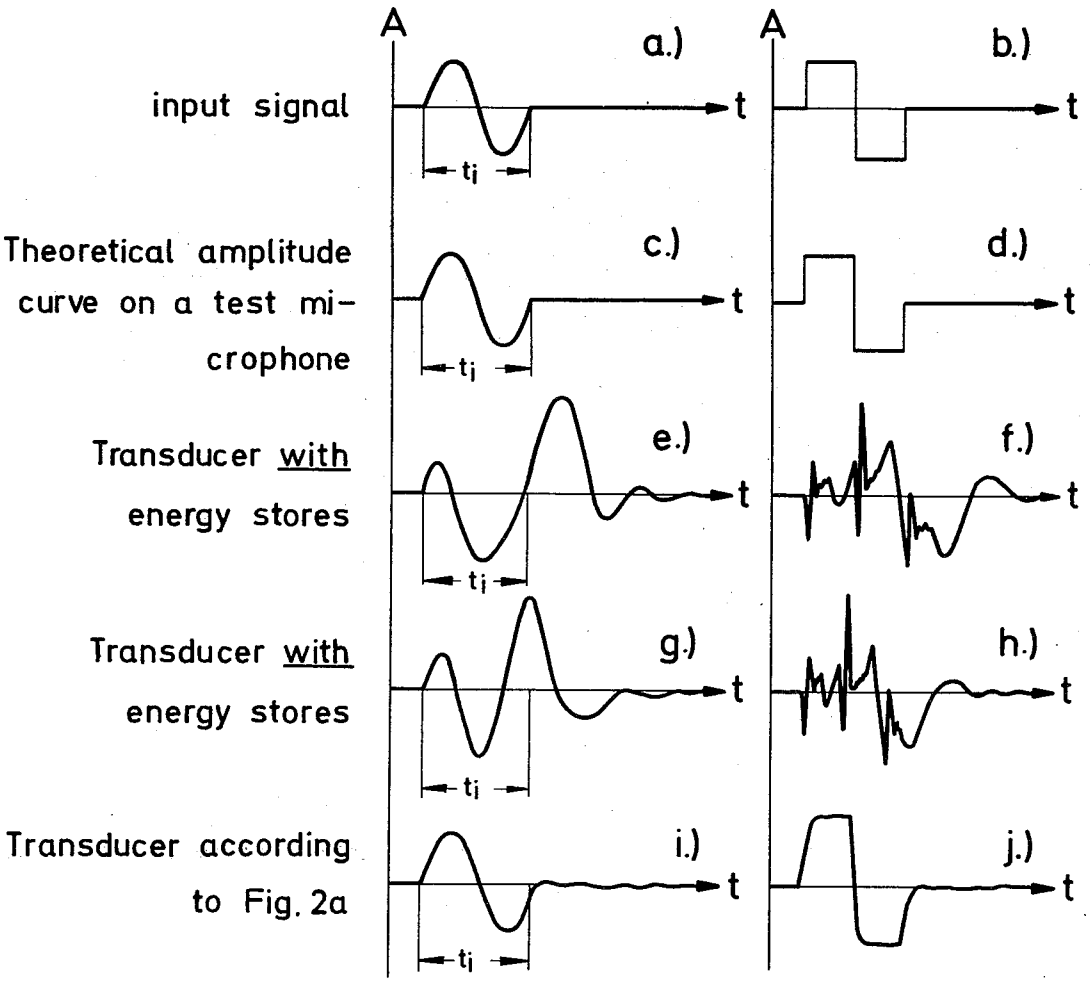
Figure 5:
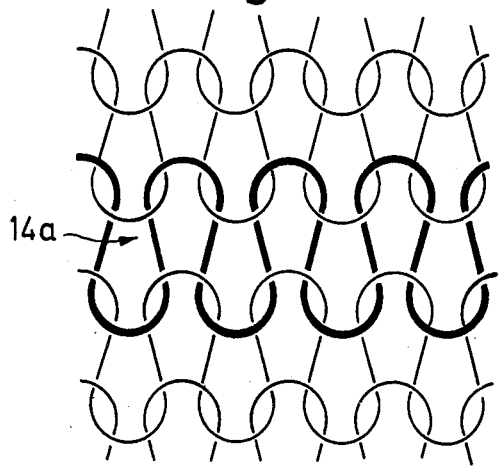
Figure 6:
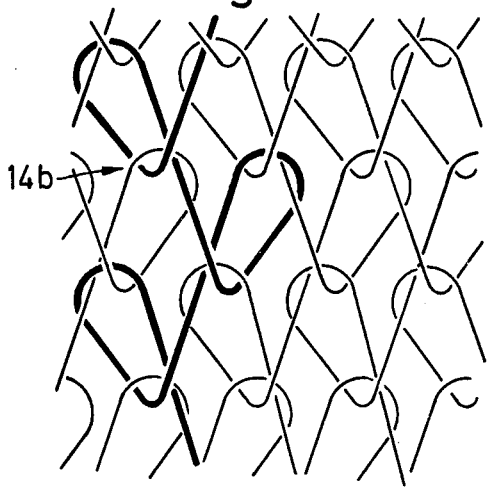

Embodiments of the present invention will now be described in detail by way of reference to the accompany drawings, wherein:

FIG. 1 is an electro-acoustic transducer with a diaphragm mounted in accordance with this invention, FIG. 2 is an electro-acoustic transducer with enclosed air chambers, FIGS. 2*a* and 3 show electro-acoustic transducer systems without the detrimental hollow spaces serving as energy stores, FIG. 4 shows the oscillation parameters for different transducer systems, and FIGS. 5 and 6 show a knitted and a warp knitted fabric.

The electro-acoustic transducer systems shown in FIGS. 1 to 3 are characterised in that the rest position of their moving coils and consequently also of their diaphragms is determined by electro-magnetic forces.

The design as shown in FIG. 1 provides for two permanent magnets represented by pot magnets 8 and 9. The arrangement of these magnets gives them the same axis of symmetry with their apertures facing each other. Two moving coils 12, 13 rigidly interconnected via bars 16, 17 or by a hollow cylinder or similar means fixed to a diaphragm 14 are movable within annular air gaps $L_1$, $L_2$. The diaphragm 14 consequently follows the rhythm of the reciprocal motions of the moving coils 12, 13. The two bars 16, 17 may be replaced, by a moving coil former 18. A known electro-magnetic system (British Pat. No. 1286676, U.S. Pat. No. 3686446) is used for the restoring of the moving coils 12, 13 and of the diaphragm 14 coupled to them.

The outer margin of the diaphragm 14 is fixed to a stationary outer ring 19 which is fitted to a stationary part of the transducer system (e.g. to the pot magnet 9) with a suitable bracket such as non-magnetic webs 21. In its rest position the diaphragm 14 is preferably arranged perpendicularly (or as near to perpendicularly as possible) to the axis of the moving coils 12, 13.

The form of construction as shown in FIG. 2 provides for only one pot magnet containing (as indicated in FIG. 2) two moving coils in tandem arrangement. This pot magnet is assembled of a plurality of pole shoe segments 23 and permanent magnet segments 24 arranged at a given spacing on a circular arc. A diaphragm 26 is fixed to a moving coil former 25 supporting the moving coils; the marginal edge of this diaphragm is rigidly clamped down by an outer ring 27 which is fixed to the pot magnet 23. The centre of the circular diaphragm 26 can also be retained in a fixed position with a pin fitted to the pot magnet. These details are not shown on the drawing. In its rest position the diaphragm is arranged in relation to the moving coil axis.

The radiating surface of diaphragm 26 (FIG. 2) is not, as in a conventional calotte loudspeaker, confined to the diaphragm section fixed within the moving coil ring 26 but rather increased by the entire diaphragm section stretched between the two rings 25 and 27. Within the moving coil former 25, the diaphragm 26 is arranged in a plane. Centering of the diaphragm 26 is accomplished by the known means (British Pat. No. 1286687, U.S. Pat. No. 3686446).

On the back of the diaphragm 26, the inner and outer pole shoes of the pot magnets 23 and the permanent magnet 24 form detrimental air spaces 28 — a phenomenon common with all conventional loudspeakers. This can be avoided by designing the pot magnet, as specified in FIG. 2*a*, to have two annular pole shoes 29, 30 and a plurality of permanent magnets 31 arranged on an arc while leaving spaces 36 free.

The embodiment according to FIG. 3 differs from that in FIG. 2*a* by the fact that the air gap L is bordered on the one side by two outer pole shoes 29*a*, 30*a* of permanent magnets 31 and on the other side by a core 33 having the function of and being constructed as a pole shoe ring. The core 33 is fixed to the pole shoes 29*a*, 30*a* via webs of a non-magnetic material (details of which are not shown). This offers a decisive advantage because there are no trapped air spaces 28 (FIG. 2) at all which during the reciprocal movement of diaphragm 26 could function as quasi-elastic energy stores and thus adversely influence the oscillating behaviour of the diaphragm. Another advantage of the designs according to FIGS. 1, 2*a* and 3 is represented by the fact that sound waves are radiated to the front as well as to the rear, because the transducer system is also opened on the back of the diaphragm. If required a pin 35, supported by thin webs 34, may be used for fixing stationary the centre of diaphragm 26. In this case the diaphragm will be absolutely symmetrically oscillated on both sides of the moving coil ring 25. The arrangement of the diaphragm with the moving coil ensures, that the diaphragm also in the deflected position as indicated by the dotted line 26*a* in FIG. 3, is not stretched and will consequently not form an elastic energy store even in this position.

The diaphragm 14 or 26, consists of a viscoelastic material which may be stretched in every direction. Particularly suitable for this purposes is highly elastic knitware 14*a* (FIG. 5) as well as warp knits 14*b* (FIG. 6). Textiles of this type offer the special property that every single loop represents a thread reserve which allows a continuous reforming of the thread position during a stretching motion. A textile fabric of this type, therefore, can be stretched to a degree unattainable by the rectilinear arranged threads of a normal woven or bonded fibre fabrics. The knitted fabrics offer on the other hand a high internal friction which in turn ensures that only intensely attenuated natural vibrations can be performed. The elasticity and attenuation property of this material can be further increased by knitting the loops not of single fibres but of a multifilament fibre with a thin single capillary arrangement. Also suitable are goods knitted with stretch yarns of S- and-/or Z-twist, the yarns being produced by the Helanca-method or by the false-twist-method and consisting e.g. of three single filaments. Usable as fibre material are materials of polyamide and polyester i.e. materials which in themselves offer a certain elasticity. The use of inextensible fibres, such as glass fibres, is by no means excluded because the essential stretching is always ensured by the loops. The best possible results are achieved with a fibre material which requires only little attenuating material and thus provides for diaphragms of an extra light weight. The use of too strongly crimped yarns should, therefore, be avoided. A weight-ratio textile carrier to filling material of 1:5 is preferred.

The diaphragm material produced on a circular or flat knitting machine, on a Cotton machine or on a warp knitting machine should be coated with an attenuating material in accordance with the same method as applied to diaphragm of woven or bonded fabrics. Suitable attenuating materials are especially solutions such as solution of butadiene copolymer (e.g. Butofan 380 D of the firm of BASF or similar).

Several methods may be used for the construction and installation of the diaphragm. The method for simultaneous construction and installation as described with reference to FIGS. 2*a* should be given preference.

The moving coil ring 25, wrapped by the moving coils, is at first centered with the aid of suitable auxiliary fixtures within the air gap of the pot magnet and then positioned in a way that ensures that its front end is mounted flush with the outer ring 27. A textile carrier element, such as a section cut from a fine lady's stocking, is then placed on the two rings 25 and 27 with their axes preferably in a vertical plane. Small weights, e.g. of eith grams each, are then suspended from the projecting edge of the knitted fabric at a uniform spacing. The textile carrier element is thus smoothly stretched at a low pre-tension. During this step the knitted fabric stretched over the rings 25, 27 should not form creases and the loops should be straight and parallel to each other. The leads of the moving coil can be drawn through the knitware from back to front if required.

After having precisely centered the moving coil and uniformly stretched the knitware in the prescribed manner, the knitware within the range of the marginal edges of the outer ring or of the moving coil, respectively, is coated with a dilute solution of the filling material which is then air dried to fix the fabric on the rings 25 and 27. Suitable for this prupose is, for instance, a 20 percent aqueous solution of Butofan 380 D.

The duly fixed fabric is then coated from the front with a 50 percent Butofan solution which is pre-dried at an air temperature of 70° C. The back of the fabric is then treated in a similar manner with filling material. The coating should generally just be thick enough that no fibre end will protrude through it on either side of the fabric. A thicker layer will be applied on both sides within the vicinity of the two rings 25, 27. Subsequently the diaphragm simultaneously produced and fixed to the rings 25 and 27 will be dried at a high temperature e.g. at 130° to 150°C. The diaphragm which has been stretched to a certain limit during the pre-drying process now relaxes almost completely due to the treatment at an elevated temperature and forms creases, which permits for the moving coils a reciprocal movement to the extent of ten to twenty millimeters in both directions without stretching the diaphragm thereby in a radial direction. The layer of filling material applied to the highly elastic knitware has converted this material into a textile element which can still be stretched in every direction but in comparison with the original knitware, not only has an essentially increased modulus of elasticity but also visoelastic behaviour.

The weights are removed after completion of the drying process, the diaphragm edges protruding beyond the outer ring 27 are trimmed and the auxiliary fixture dismantled.

The simultaneous construction and fitting of the diaphragm offers the decisive advantage that after this treatment the moving coil is centered in a direction perpendicular to the direction of motion alone by the diaphragm and is thus ready for use without any further measures being necessary.

Another possible method of making and fixing the diaphragm comprises first pre-fixing the diaphragm material at 195°C so that it has 140 loops per 49 $mm^2$ (square millimeters). After pre-loading by the weights, the diaphragm material is then clamped to the outer ring and separated, whereupon the coil is arranged concentrically of the outer ring by means of an auxiliary fixture. The whole arrangement is finally passed under a curtain of filling material, for example Butofan 390 D, it being possible to provide pre-drying and final drying as in the above example. Fixing of the diaphragm to the outer ring, fixing of the coil to the diaphragm and appropriate filling of the diaphragm material are carried out in one process step.

A diaphragm of a plain knitted fabric, produced on a circular knitting machine of a 20/3/1 Nylon-Yarn, was used for an exemplary embodiment of the invention; the sequential loop course of this fabric are composed of yarns alternatingly S-twisted and X-twisted, with a twist of 1800 to 2400 revolutions per meter of yarn. The fabric was subsequently drawn over a cylindrical former in a manner which ensured that the individual loops were twisted out of the knitting plane until they were uniformly and vertically aligned in relation to this plane. In this condition the fabric was pre-fixed at a temperature of about 105° to 110°C and simultaneously dyed. After completion of these process steps the fabric was once more drawn over a cylindrical former until a loop density of about 3 loops per square millimeter was attained. In this condition the diaphragm material was once more fixed. Prior to the treatment with the filling material the loops should preferably protrude by 0.2 to 0.3 mm from the knitted fabric in order to provide a diaphragm thickness of approximately 0.25 to 0.4 mm after treatment with the filling material.

The finished diaphragm offers, according to DIN 53362, a bending resistance of 1 to 10 $g/cm^2$ and a specific gravity of 1 to 1.1 $g/cm^3$. The logarithmic attenuation decrement is 4 to 20 if exposed to a torsional oscillating test according to DIN 53445 or ISO/DOR 533, respectively. The tensile test shows that with a pure carrier material (knitted fabric) an elongated of 10 percent is achieved with a weight of 2.5 g within a few minutes, while in case of the finished diaphragm the same elongation is reached with weight of 260g, the process becoming stable only after a period of 30 min. During operation of the electro-acoustic transducer system as described in FIGS. 1 to 3 the moving coils are deflected in an axial direction depending on the electrical oscillation applied; the diaphragms fixed to the moving coils and possibly clamped by their edges being thus set in reciprocating motion. Within the bass range, i.e. at relatively large deflection amplitudes, the diaphragms will move in their entirety because the tensile forces acting on the points at which the diaphragms are fixed to the moving coil formers 18 or 25 remain in-phase effectively up to the diaphragm edge or the diaphragm centre (FIG. 3). An ever smaller part of the diaphragm participates in the reciprocating movements as the frequencies increase and the deflection amplitudes decrease until only a very minor part of the diaphragm is set in oscillation and acts as radiating surface at very high frequencies. In this case the oscillating parts extend barely a few millimeters from the fixing point in a radial direction. Identical conditions will be produced on both sides of the moving coil formers 18, 25 depending on whether or not the diaphragm is clamped on only one side (FIGS. 1, 2 and 2*a*) or on both sides (FIG. 3). Although the diaphragm may be fastened to the moving coil ring 25 in a manner which divides it into approximately two equal sections, of which one is arranged outside and the other inside the moving coil ring, in the preferred arrangement the diameter of the moving coil former 25 is equal to the radius of the diaphragm 26 or of the outer ring 27. This ensures that the diaphragm is held by the moving coil former 25 precisely centrally.

The diameter of the moving coil and of the coil former should be adequate to ensure, in conjunction with electro-magnetic-centering a non-tilting positioning of the coil former i.e. so that its axis is kept parallel to that of the air gap. The consequence of a moving coil former with an inadequate diameter could be that even a slight asymmetry in fixing the diaphragm would result in tilting of the moving coil such that it would come to rest on the pole shoe surfaces. Diameters of 50 to 90 mm for example are preferred for the moving coil former.

The pole shoes should offer surfaces of approximately the same size on both sides of the moving coil former 25 in order to ensure that the air cushions behind the diaphragm, which are to be displaced on return diaphragm motions, are symmetrically arranged.

The transducer system according to this invention offers decisive advantages over conventional calotte loudspeakers in that the radiating surface of the diaphragm can be drastically increased without adverse natural oscillations being generated. This advantageous feature can be realized because the diaphragm material has no adverse influence on the oscillatory behaviour of the transducer system and because that part of the diaphragm, which radiates sound waves at a certain frequency, is automatically adjusted within the diaphragm in accordance with the power transmission ratio.

The invention is not limited to the examples given but can be modified in several ways. The magnet designs, as shown in FIG. 3, may, for instance, be replaced by other designs without any enclosed air chambers on the back of the diaphragm.

The diaphragm of this invention is by no means limited to the design examples described even though the transducer system according to FIG. 2*a* offers a maximum of advantageous features as its diaphragm and the electro-magnetic restoring excludes the three detrimental energy stores. The diaphragm of this invention may also be used with calotte loudspeakers. Because the diaphragm of this invention, however, has only a low rigidity it will be within the former 25 of a flat type according to FIGS. 2, 2*a* and not of the usual calotte configuration. The radiating wedge can be enlarged if the diaphragm is fixed at its centre according to FIG. 3. The invention is, moreover, not limited to transducer systems with electro-magnetic restoration but can also be used with the conventional transducer systems making use of a mechanical restoration by using for the diaphragms, as specified on FIGS. 1 to 3, additional centering diaphragms or restoring springs.

A wide scope is also given to the shape, material and arrangement of the diaphragms. Preference is given to circular or square diaphragms configurations with a symmetrical coupling to the moving coil but without excluding the use of other diaphragm configurations. Highly suitable for these diaphragms are knitted fabrics made on flat or circular knitting machines; no specifications are offered as to weaves and loop sizes, which must, however, ensure that high flexibility is maintained. Highly suitable are plain or rib knitted fabrics such as can be cut from a standard fine gauge lady's stocking. The arrangement given to the diaphragms on FIGS. 1 to 3 ensures that the diaphragms in their rest position are located vertically to the axis of motion of the moving coils. Modifications are possible and the drive axis as well as the diaphragm surface may be arranged at an angle other than 90° as a modified angle will possibly influence the size and position of the radiating wedge but never the double amplitude and phase coincidence transducing effect. The oscillating behaviour of an ideal, a conventional and of an electro-acoustic transducer system of this invention, are shown diagrammatically in FIG. 4. FIGS. 4*a* and *b* show each a sine and a square oscillation applied to the transducer, the amplitudes being drawn alongside the ordinate while the time axis is represented by the abscissa. The ideal configuration of acoustic oscillations as emitted by the transducer are represented in FIGS. 4*c* and 4*d*. FIGS. 4*e*, 4*f*, 4*g* and 4*h* show that the sound oscillations as produced by a conventional transducer are, within the period of the applied sine wave, not only strongly distorted by the interfering energy store but also gradually declining along a branch beyond the end of the period. The transducer, as specified in this invention, produces according to FIGS. 4*i* and *j* within the entire sound frequency range curves which can be hardly distinguished from the ideal ones shown in FIGS. 4*c* and *d*.

The advantages offered by the transducer system as specified in this invention may not only be applied to loudspeakers and diaphragms but also to microphones and headphones.

I claim:

1. An electro-acoustic transducer system comprising:

a magnetic system having pole shoes and an air gap limited by said pole shoes;

a substantially flat viscoelastic diaphragm which is highly elastically stretchable;

fixed support means fixed to said magnetic system and supporting said diaphragm; and moving coil means fixed to a portion of said diaphragm.

2. A transducer system according to claim 1 wherein the carrier element is composed of a fibre material with interlooped fibres.

3. An electro-acoustic transducer system as claimed in claim 1, wherein the weight-ratio of said textile carrier element to said filling material is of the order of 1 to 5.

4. A transducer system according to claim 1 wherein the outer margin of the diaphragm is fitted to an outer ring which in turn is fixed to a stationary part of the transducer system.

5. A transducer system according to claim 1 wherein the knitted material is a warp knitted fabric.

6. A transducer system according to claim 1 the filling material being applied to the diaphragm under a little pre-tension of the textile element.

7. A transducer system according to claim 1 wherein the rest position of the moving coil(s) in its axial direction is wholly determined by electro-magnetic forces.

8. A transducer system according to claim 1 wherein the diaphragm is stationarily fixed at its centre.

9. A transducer system according to claim 1 wherein the diaphragm is fitted to a moving coil former which is coupled to the moving coil, and wherein the diaphragm is divided by the moving coil former into sections of substantially the same size.

10. A transducer system according to claim 9 wherein the diaphragm is of a circular shape and wherein the diameter of the moving coil former is substantially equal to the radius of the diaphragm.

11. A transducer system according to claim 1 wherein no enclosed air chambers are provided behind the diaphragm.

12. A transducer system according to claim 11 wherein the moving coil(s) is/are arranged within an air gap the inner marginal edge of which is limited by a thin pole shoe ring.

13. A transducer system according to claim 11 including permanent magnets arranged in a plurality of segments at a given spacing around a circular arc.

* * * * *